United States Patent [19]

Reavley

[11] Patent Number: 5,006,091

[45] Date of Patent: Apr. 9, 1991

[54] COIN COUNT VERIFIER

[76] Inventor: Francis Reavley, 206-20 Bradmon Drive, St. Catharines, Ontario, Canada, L2M 3S2

[21] Appl. No.: 289,820

[22] Filed: Dec. 27, 1988

[51] Int. Cl.[5] ..... G07D 9/00

[52] U.S. Cl. ..... 453/59; 453/60; 53/254

[58] Field of Search ..... 453/59, 60; 53/213, 53/254; 229/87.2

[56] References Cited

U.S. PATENT DOCUMENTS

| | | | |
|---|---|---|---|
| 583,808 | 6/1897 | Lazell | 453/60 X |
| 1,130,978 | 3/1915 | Jackson | 53/213 |
| 2,342,761 | 2/1944 | Simpson | 453/60 X |
| 2,590,241 | 3/1952 | Ewart | 53/213 |
| 2,637,960 | 5/1953 | Powers | 53/213 |
| 2,736,478 | 2/1956 | Bernhardt | 53/254 |
| 2,966,769 | 1/1961 | Iob | 53/254 |
| 3,107,467 | 10/1963 | Gates | 453/60 X |
| 4,764,151 | 8/1988 | Sandhage | 453/59 |

FOREIGN PATENT DOCUMENTS

| | | | |
|---|---|---|---|
| 632030 | 12/1961 | Canada | 453/60 |
| 7057 | 10/1904 | Denmark | 453/59 |

*Primary Examiner*—F. J. Bartuska

[57] ABSTRACT

A coin count verifier having an elongated body with an abutment disposed at one end and a coin receiving trough extending longitudinally along one surface of the body, the coin receiving trough declines from the other end of the body towards the abutment, the abutment spans across and is integral with the coin receiving trough. The abutment is disposed an obtuse angle relative to the coin receiving trough and extends beyond the coin receiving trough.

3 Claims, 4 Drawing Sheets

COIN COUNT VERIFIER

FIELD OF INVENTION

This invention relates to a coin count verifier, and in particular relates to a coin count verifier adapted to elevate the leading edge of coins so as to facilitate a coin cartridge to be slipped around the coins for storage.

BACKGROUND TO THE INVENTION

Various devices have heretofore been proposed and constructed in order to facilitate the counting and wrapping of coins.

For example, U.S. Pat. No. 2,342,761 discloses a coin wrapping device including a trough having upper walls inclined at a horizontal plane and includes a tongue bent downwardly adjacent its free end so as to provide a coin abutment member disposed in a vertical plane.

Furthermore, U.S. Pat. No. 2,736,478 shows a coin counter having a shell V-shaped and tilted angularly back towards a bumper which is designed to contact the coins tangentially so as to hold them in a substantially vertical position.

Moreover, U.S. Pat. No. 1,130,978 also teaches a coin wrapping device having a trough or coin receiving structure for counting coins.

Still another coin counting device is disclosed in U.S. Pat. No. 2,394,886 which includes a series of rolls adapted to engage a sheet of paper for automatically wrapping a stack of coins.

Finally, U.S. Pat. No. 2,637,960 teaches a coin wrapping device.

Each of the prior art devices disclosed above present relatively complex structure which is subject to malfunction in operation from time to time and in some cases present relatively expensive structure to manufacture.

It is an object of this invention to provide a coin count verifier which is relatively simple to construct and adapted for continued use with little possibility of malfunction with reasonable usage.

It is a further object of this invention to provide a coin count verifier which allows a coin cartridge to quickly and easily receive a stack of coins.

The broadest aspect of this invention relates to a coin count verifier comprising an elongated body having a lower surface; abutment disposed at one end of said body; and coin receiving means extending longitudinally along one surface of said body, said coin receiving means declining from said other end of said body towards said abutment means at said one end of said body, said abutment means spanning across and integral with said coin receiving means, said abutment means disposed at an obtuse angle relative said coin receiving means and extending beyond said coin receiving means and said coin receiving means is disposed at an acute angle relative said lower surface.

It is another aspect of this invention to provide a coin count verifier adapted to contain coins to be collected in a coin cartridge, said verifier comprising: an elongated body having a lower surface and an upper surface and one end opposite to another end said lower surface adapted to rest along a horizontal surface; coin receiving means having a curved cross-section for receiving said coins, said coin receiving means extending longitudinally along said upper surface of said elongated body, between said ends said coin receiving means declining from said one end of said body to said other end; abutment means disposed at said other end of said body said abutment means spanning across and integral with said coin receiving means, said abutment means disposed at an angle greater than 90° relative said coin receiving means and extending beyond said upper surface wherein said coins are adapted to bear against said abutment means and said coin receiving means disposed at an acute angle relative said lower surface, so as to cause sad coins contained in said coin receiving means to bear against said abutment means at an angle greater than 90° relative said coin receiving means so as to elevate the leading edge of said coins from said coin receiving means and facilitate said coin cartridge to be slipped around said coins for retaining said coins.

It is another aspect of this invention to provide the combination of a coin counter verifier, cylinder means and a pad of paper containing sheets which are capable of being removed from said pad, said sheets adapted to be rolled about said cylinder means so as to produce coin cartridges for use in association with said coin count verifier, said coin count verifier including: an elongated body having a lower surface and an upper surface and one end opposite to another end; coin receiving means having a curved cross section for receiving said coins, said coin receiving means extending longitudinally along said upper surface of said elongated body between the said ends, said coin receiving means declining from said one end of said body to said other end; abutment means disposed at said other end of said body, said abutment means spanning across and integral with said coin receiving means, said coin receiving means disposed at an angle greater than 90° relative said coin receiving means, and extending beyond said upper surface; said coin receiving disposed at an acute angle relative said lower surface; recess means presented by said abutment means in the vicinity of said recess means for receiving a portion of said coin cartridge so as to facilitate the introduction of coins into said coin cartridge from said coin receiving means.

DESCRIPTION OF THE INVENTION

Like parts have been given identical numbers throughout the figures.

Figure 1:
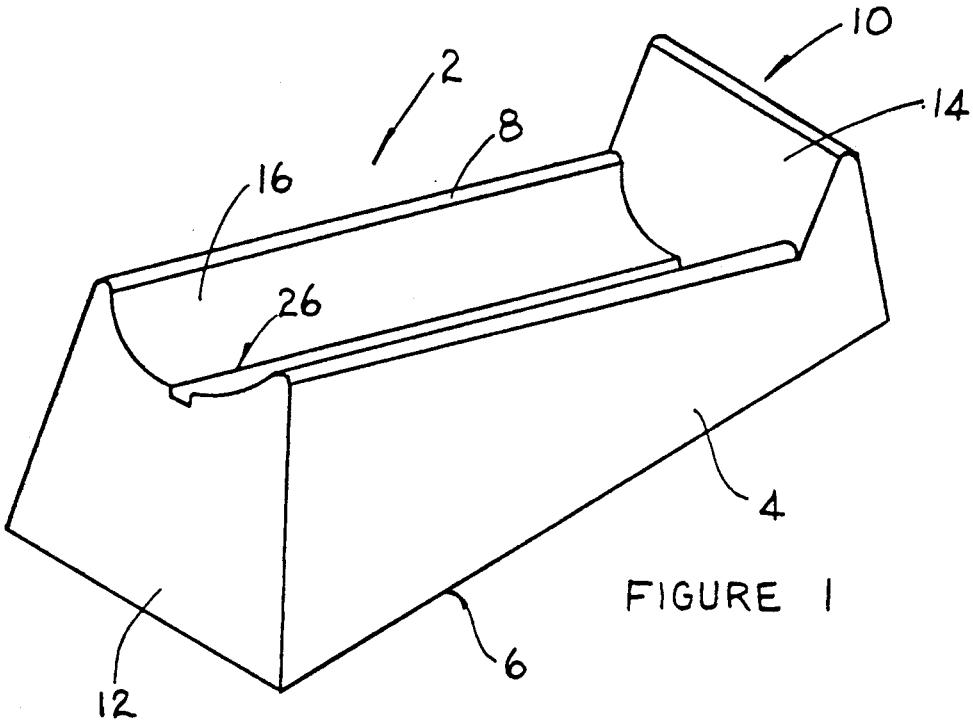
FIG. 1 is a perspective view of said coin count verifier taken from a view about said coin receiving structure.

FIG. 1 illustrates the coin count verifier generally designated as 2. The coin count verifier generally comprises an elongated body 4 having a lower surface 6 adapted to rest against a table top or the like and also includes an upper surface 8 as well as two opposite ends 10 and 12. The coin count verifier 2 can be manufactured from a variety of materials include sheet metal, plastics or the like. In the preferred embodiment the coin count verifier is comprised of high impact styrene material 60 thousandths of an inch in thickness which is totally enclosed around and re-enforced for added strength. Accordingly, the coin count verifier as described herein can be easily manufactured by injection molding means in a manner well known to those persons skilled in the art.

The coin count verifier 2 includes an abutment 14 which is presented at one end 10 of said coin count verifier 2. The coin count verifier 2 also includes a coin receiving structure 16 which extends longitudinally along the upper surface 8 of said elongated body 2. The coin receiving structure 16 generally presenting a curved or concave cross-section. The coin receiving structure or trough 16 extends generally from the other end 12 of said coin count verifier 2 and declines from the other end 12 toward the abutment 14 at end 10.

Figure 5:
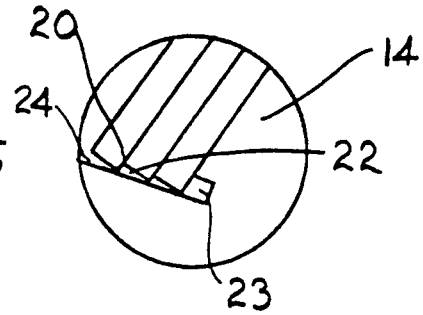
FIG. 5 is an enlarged view of area 19 of FIG. 3.
Figure 2:
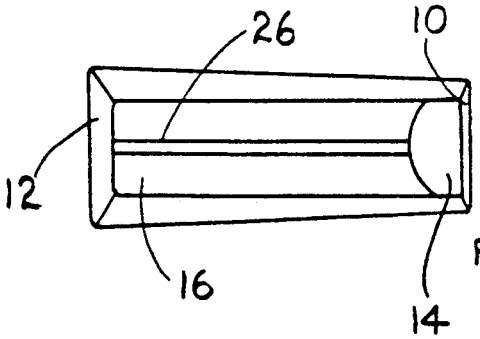
FIG. 2 is a top plan view of said coin count verifier.
Figure 3:
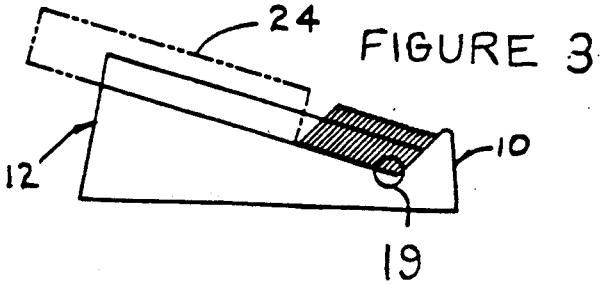
FIG. 3 is a side elevational view of said coin count verifier.
Figure 4:
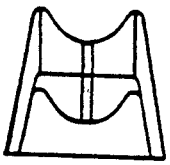
FIG. 4 is an end elevational view of said coin count verifier.

The abutment structure 14 is disposed at an obtuse angle, that is at an angle greater than 90° relative the coin receiving structure 16 so as to cause the coins contained in said coin receiving structure to bear against the abutment structure at an angle greater than 90° relative said coin receiving structure 16. This is best illustrated in FIG. 5. As the coins 18 in trough or coin receiving structure 16 bear against the abutment structure 14, the leading edge 20 of said coins is elevated from the coin receiving structure 16 so as to produce a space 22 which facilitates a coin cartridge 24 to be slipped around the coins 18 for gathering and retaining the coins 18.

By disposing the abutment structure 14 at an angle greater than 90° to the lower portion of the trough or coin receiving structure 16 several advantages of a coin counter have been accomplished, namely:

(a) the circumferential contact of the coin edges with the internal circumference of the cartridge has been reduced so as to provide for easier placement of the cartridge 24 over coins 18; that is the effective diameter of the coins has been reduced so that the cartridge 24 may be easily slipped over and under the coins 18.

(b) by allowing a space between the leading edge 20 of coins 18 with trough 16, the cartridge 24 may be easily slipped over and under the coins 18 with speed and simplicity;

(c) the abutment 14 is stationary and needs no adjustment and is high enough in most cases to prevent any over balancing of almost an coin in the world.

Although the preferred embodiment illustrates a stationary abutment a movable or displaceable abutment may also be used and the drawings should not be restricted to the exact form shown therein. Furthermore in another embodiment of the invention the abutment may also include a space or recess 23 so as to receive a portion of cartridge 24 as best illustrated in FIG. 5.

The coin receiving structure or trough 16 also includes a groove 26 which extends longitudinally along the bottom of the trough 16 whereby the groove 26 is adapted to contain indicia for representing the count of coins to be contained in the coin receiving structure 16. The coin counter 2 is manufactured so that the longitudinally length of the trough 16 would contain a row of the most often count of coins. For example, both in Canada and in the United States coin cartridges 24 are manufactured so as to contain $0.50 in pennies, $2.00 in five cent pieces, $5.00 in ten cent pieces, $10.00 in twenty-five cent pieces and $25.00 in one dollar pieces. Accordingly, the longitudinally length of trough 16 and the indicia in groove 26 would be manufactured so as to accommodate the various sizes.

Accordingly the time required to verify the count of coins 18 in the coin count verifier 2 is substantially reduced. In practice it has been found that the time required by young and old users of the verifier 2 for applying the cartridge around the coins averages one second depending on the skill of the user.

It should also be noted that coin count verifier 2 may be manufactured in a variety of colours so as to easily distinguish a count of different foreign currencies or type of coin.

Figure 6:
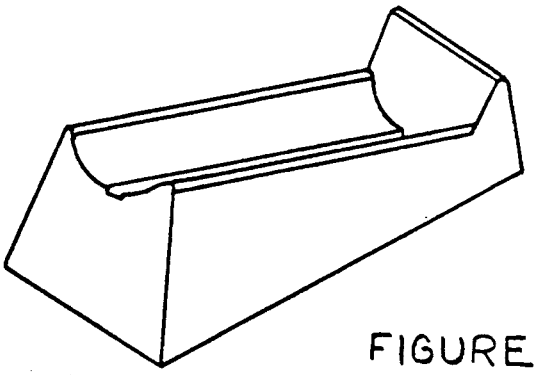
FIG. 6 is a view illustrating the kit comprising a coin count verifier, a cylinder and pad of paper.

FIG. 6 illustrates a kit 50 which comprises of a coin count verifier 2 a cylinder 52 and pad of paper 54. The pad 54 comprises a plurality of sheets 56 which are adapted to be removed from the pad 54 and wrapped around the exterior diameter of cylinder 52 so as to produce a coin cylinder 24. One end of each sheet 56 may be adapted to contain an adhesive or gummed edge 55 which will retain the sheet 56 in a coin cartridge once it has been formed around cylinder 52. Each sheet 56 may also contain indicia so as to illustrate the number and type of coins contained in the coin cartridge. A variety of cylindrical rollers 52 ma be utilized for the different types of coins.

Figure 7:
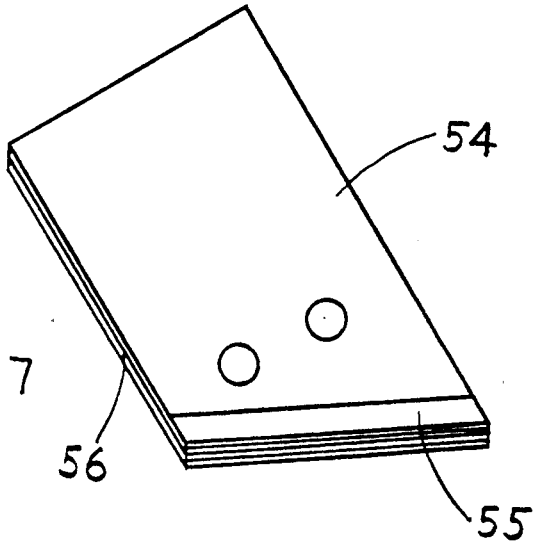
FIG. 7 is a perspective view of a second embodiment of said coin count verifier.
Figure 8:
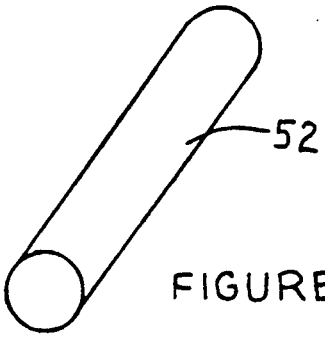
FIG. 8 is a side elevational view of the coin count verifier of FIG. 7.
Figure 9:
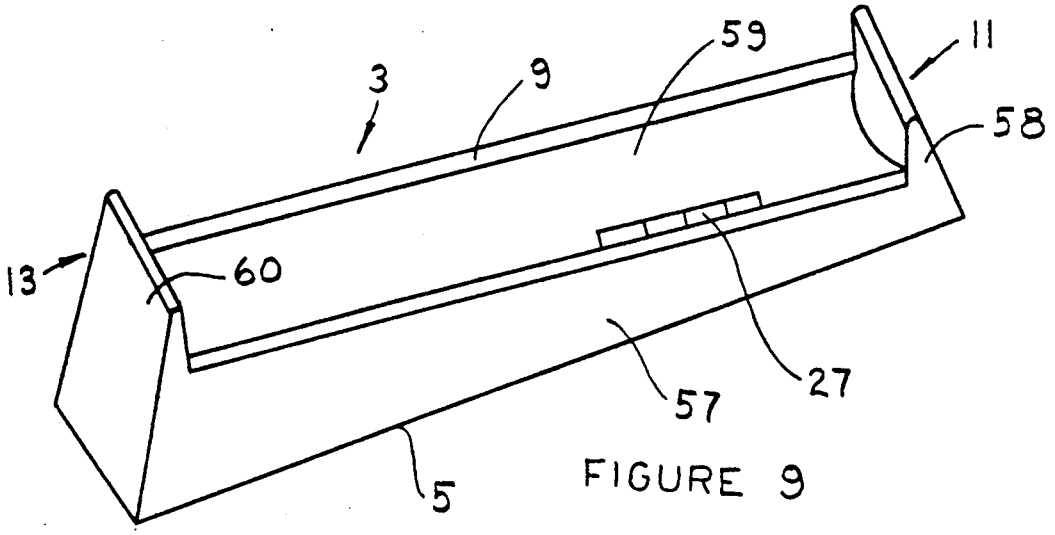
FIG. 9 is a top plan view of the coin count verifier of FIG. 7.
Figure 10:
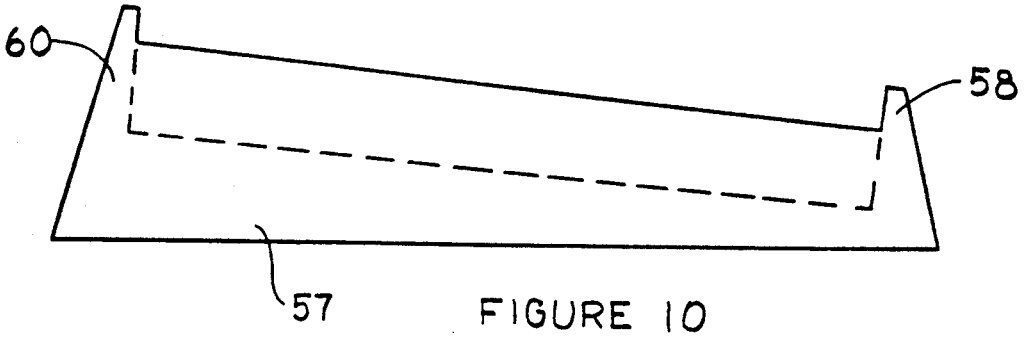
FIG. 10 is a side elevational view of the coin count verifier of FIG. 7 showing the coins and cartridge in position.

FIG. 7 illustrates a second embodiment of a coin count verifier 3. The coin count verifier 3 comprises an elongated body 57 having a lower surface 5 adapted to rest against a tabletop or the like and also includes a upper surface 9 as well as two opposite ends 11 and 13.

The coin count verifier 3 illustrated in FIGS. 7 through 11 inclusive includes an abutment 58 which is presented at one end 11 of the coin count verifier 3 and a stop 60 at the other end of the elongated body 57. Trough 59 extends longitudinally along the upper surface 9 of the elongated body 57. The trough 59 declines from the second end 13 towards the first end 11. The abutment structure 58 and stop 60 are disposed at each end 11 and 13 respectively of the trough 59 at a 90° angle relative to said trough 59.

The trough 59 includes indicia 27 for representing the counted coins to be contained in the trough or receiving structure 59.

The elongated body 57 and trough 59 extends longitudinally for a sufficient length so that coins may be stacked in the lower end of the trough 59 adjacent abutment 58 to be visually verified by indicia 27 while at the same time adapted to contain a coin cartridge 24 to be disposed in the vicinity of the raised area of the trough 59 adjacent stop 58.

Once the coins 18 have been verified by the coin count verifier 3 the coins 18 may be automatically transferred to the coin cartridge 24 by elevating the lower end 11 containing the coins 18 to the necessary elevation or degree so as to slip the coins 18 into the cartridge 24.

Figure 11:
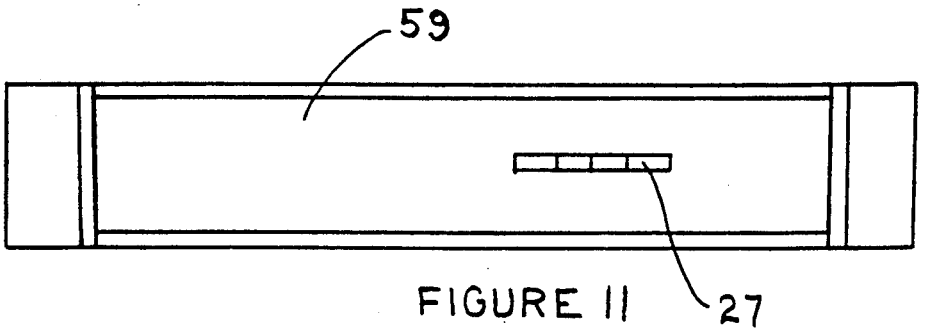
FIG. 11 is a side elevational view of FIG. 10 showing the action of the coins slipping into the cartridge upon elevation of the lower end of the coin count verifier.
Figure 12:
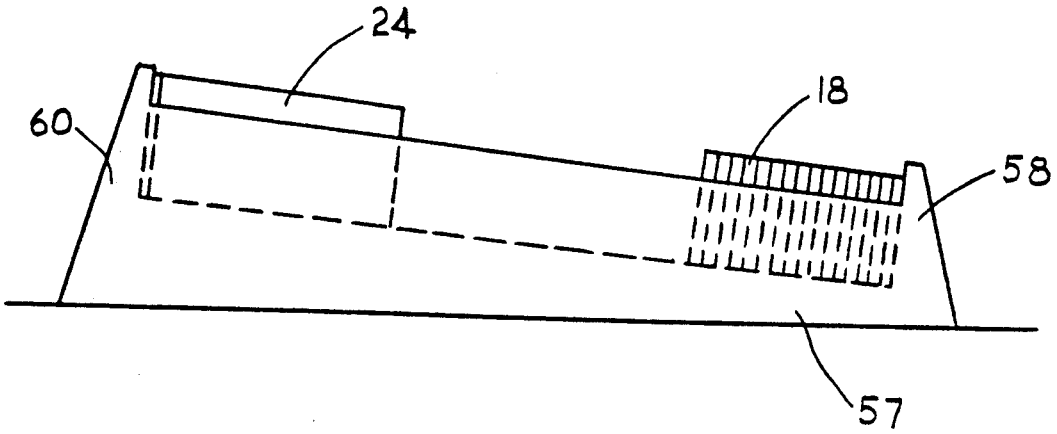
Figure 13:
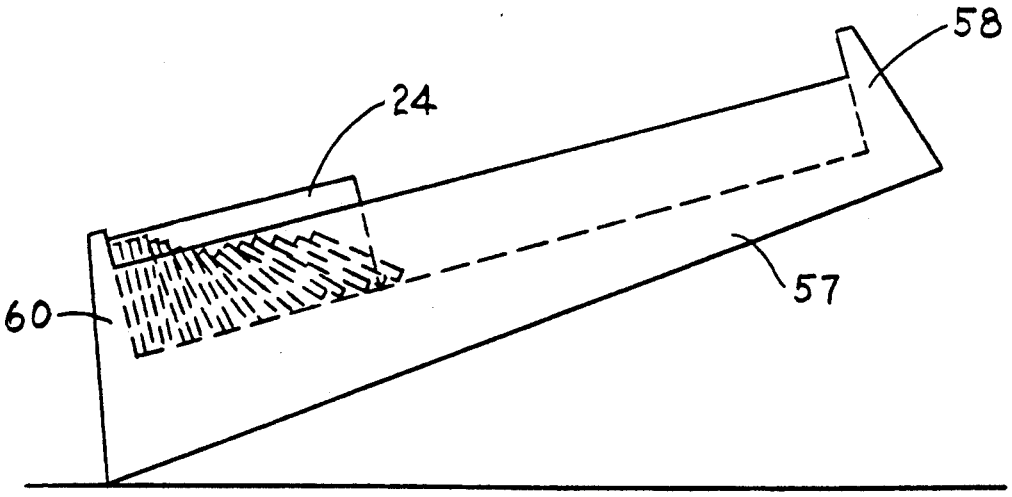

It will be noted from FIG. 11 that the action of elevating the lower end 11 causes the coins 18 to tilt away from abutment 58 due to the action of gravity which causes the trailing edge of coins 18 to be elevated which facilitates the coins 18 to fall into coin cartridge 24 for retaining the coins 18.

Although the preferred embodiment as well as the operation and use have been specifically described in relation to the drawings, it should be understood that variations in the preferred embodiment could easily be achieved by a man skilled in the art without departing from the spirit of the invention. Accordingly, the invention should not be understood to be limited to the exact form revealed by the drawings.

The embodiments of the invention in which an exclusive property or privilege is claimed are defined as follows:

1. The combination of a coin counter verifier, cylinder means and a pad of paper containing sheets which are capable of being removed from said pad, said sheets adapted to be rolled about said cylinder means so as to produce coin cartridges for use in association with said coin count verifier, said coin count verifier including:

(a) an elongated body having a lower surface and an upper surface and one end opposite to another end;

(b) coin receiving means having a curved cross section for receiving said coins, said coin receiving means extending longitudinally along said upper surface of said elongated body between the said ends, said coin receiving means declining from said one end of said body to said other end;

(c) abutment means disposed at said other end of said body, said abutment means spanning across and integral with said coin receiving means, said coin receiving means disposed at an angle greater than 90° relative said coin receiving means, and extending beyond said upper surface;

(d) said coin receiving means disposed at an acute angle relative said lower surface;

(e) recess means presented by said abutment means in the vicinity of said recess means for receiving a portion of said coin cartridge so as to facilitate the introduction of coins into said coin cartridge from said coin receiving means.

2. The combination as claimed in claim 1 wherein said cylinder and said pad of paper comprise different sizes for different denominations of coins.

3. The combination as claimed in claim 2 wherein said coin receiving means include groove means, said groove means adapted to contain indicia for representing the count of coins contained in said coin receiving means.

* * * * *